United States Patent [19]

Williams

[11] 3,994,519

[45] Nov. 30, 1976

[54] THERMOS GUARD

[75] Inventor: Dolores S. Williams, Port Jefferson Station, N.Y.

[73] Assignee: Lawrence Peska Associates, Inc., New York, N.Y. ; a part interest

[22] Filed: May 7, 1975

[21] Appl. No.: 575,168

[52] U.S. Cl. ..... 292/246; 292/307 R

[51] Int. Cl.[2] ..... B65D 33/34

[58] Field of Search ..... 292/104, 205, 253, 307, 292/318, 320

[56] References Cited

UNITED STATES PATENTS

| | | | |
|---|---|---|---|
| 583,159 | 5/1897 | Ward | 292/253 |
| 1,235,482 | 7/1917 | Johnson | 292/286 |
| 1,648,152 | 11/1927 | Schäfer | 292/307 R X |
| 2,015,663 | 10/1935 | Chambless | 292/107 |
| 2,346,881 | 4/1944 | Valenti | 292/320 X |
| 3,556,575 | 1/1971 | Farkas | 292/318 X |

*Primary Examiner*—Richard E. Moore

*Attorney, Agent, or Firm*—Eugene V. Mandel

[57] ABSTRACT

A lunch box having a latch further equipped with a bendable security closure for the latch.

6 Claims, 5 Drawing Figures

THERMOS GUARD

BACKGROUND OF THE INVENTION

This invention relates to security devices for latches for lunch boxes.

The common lunch box available in stores has the annoying habit of unlatching and opening and distributing the contents far and wide in an embarrassing and unsanitary manner. Very often the insulated jar or thermos bottle falls out and cracks. It is usually difficult to obtain a replacement glass liner for the insulated jar. As a result, the accidental opening of the latch usually results in a ruined lunch and the complete replacement of the insulated jar.

Although some secondary security devices for latches have been known, these have been cumbersome, expensive, and difficult in use.

It is the object of this invention to provide a low cost, easy to use, secondary latch security device for lunch boxes. The essence of this invention is a simple low cost easy to use security device for lunch box latches comprising a readily bendable member.

Further objects and advantages of this invention will appear more clearly from the following description of a non-limiting illustrative embodiment and the accompanying drawings in which like numerals designate like parts throughout the several views.

DESCRIPTION OF A TYPICAL EMBODIMENT

Figure 3:
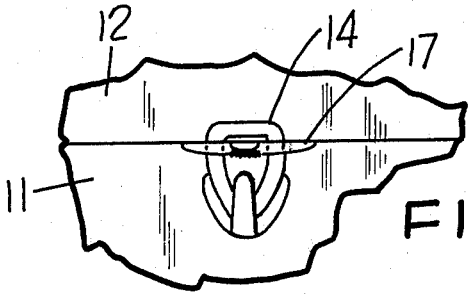
FIG. 3 shows the latch.

A typical lunch box is comprised of a body 11, a lid 12, held together by a hinge 18 and secured by a latch 13, 14 and carried by a handle 16. In order to secure the swinging latch 14 from opening, a bendable member 17 can be attached to first part of the latch 13 and then passed thru the opening 20 in latch 14. After passing thru, member 17 can be bent over around the edge of latch 14. Member 17 must now either be broken or bent back in order to release latch 14. In one neat application, member 17, after being passed thru opening 20 of latch 14, is separated and bent out two ways to secure latch 14 as shown in FIG. 3.

Figure 1:
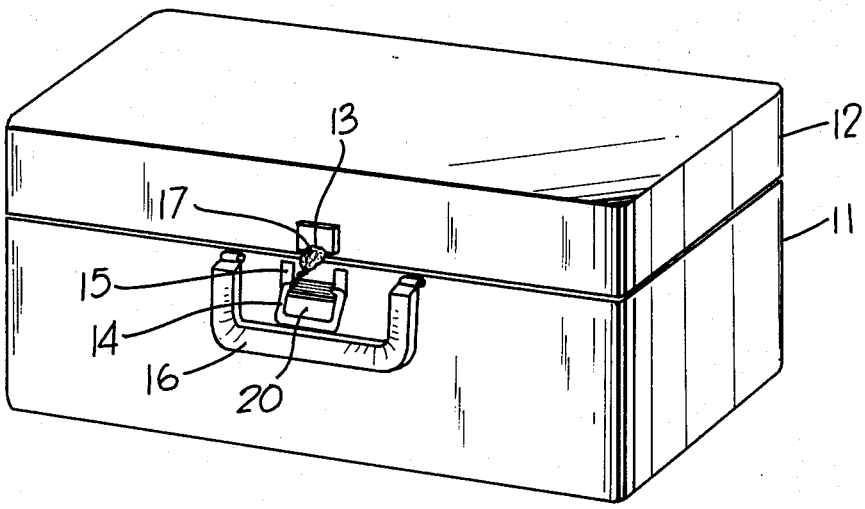
FIG. 1 is a pictorial view of a lunch box.
Figure 4:
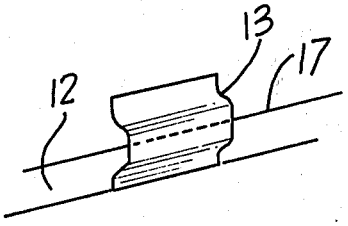
FIG. 4 shows the bendable member in the latch.
Figure 2:
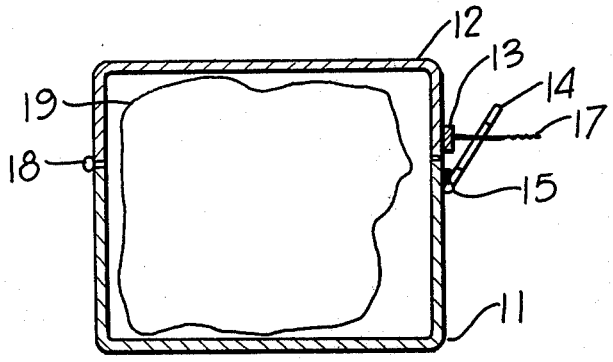
FIG. 2 is a cross-section of FIG. 1.
Figure 5:
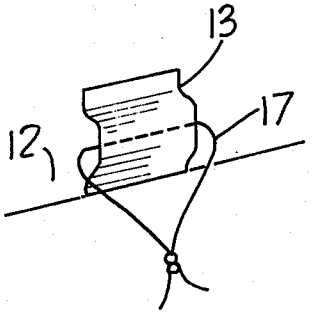
FIG. 5 shows the bendable member in the latch.

Member 17 may be twisted after passing thru latch 13 but before entering latch 14 for greater security against loss of member 17 as shown in FIG. 5.

Member 17 must be bendable and can be made of metal wire, plastic, paper, or a combination thereof. Member 17 can be attached to latch 13 in various ways including passing thru, twisting around, or by fusion such as by welding or soldering.

The invention includes all novelty residing in the description and drawings. It is obvious to those skilled in the art that various minor changes can be made without departing from the concept of this invention and all such as fall within the reasonable scope of the appended claims are claimed.

What is claimed is:

1. In a lunch box having a latch having at least two parts at least one part of which is fixed to the lunch box and not movable, the improvement comprising the addition of a secondary closure including a readily hand bendable member attached to one part of said latch, said bendable member passed thru the other part of said latch and bent around it in order to further secure said latch against opening.

2. In a device as in claim 1, the bendable member is attached to the first part of said latch by being passed thru it.

3. In a device as in claim 1, the bendable member comprised of a metal.

4. In a device as in claim 1, the bendable member comprised of paper.

5. In a device as in claim 1, the bendable member comprised of plastic.

6. In a device as in claim 1, the bendable member is attached to the first part of said latch by fusion.

* * * * *